US010638215B2

(12) United States Patent
Breen et al.

(10) Patent No.: US 10,638,215 B2
(45) **Date of Patent: *Apr. 28, 2020**

(54) HEADPHONE JOINT

(71) Applicant: Bose Corporation, Framingham, MA (US)

(72) Inventors: John J. Breen, Southborough, MA (US); Eric M. Wallace, Andover, MA (US); Michael J. Monahan, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/390,389

(22) Filed: Apr. 22, 2019

(65) Prior Publication Data

US 2019/0246197 A1 Aug. 8, 2019

Related U.S. Application Data

(63) Continuation of application No. 15/874,108, filed on Jan. 18, 2018, now Pat. No. 10,271,125, which is a continuation of application No. 15/063,419, filed on Mar. 7, 2016, now Pat. No. 9,900,682.

(51) Int. Cl.

| | |
|---|---|
| ***H04R 1/00*** | (2006.01) |
| ***H04R 1/10*** | (2006.01) |
| *H04R 5/033* | (2006.01) |

(52) U.S. Cl.

CPC ..... *H04R 1/1066* (2013.01); *H04R 1/1008* (2013.01); *H04R 1/1041* (2013.01); *H04R 1/1058* (2013.01); *H04R 1/105* (2013.01); *H04R 5/0335* (2013.01); *H04R 2201/025* (2013.01)

(58) Field of Classification Search

CPC ..... H04R 1/10; H04R 1/1058; H04R 1/1066; A61F 11/14

See application file for complete search history.

(56) References Cited

FOREIGN PATENT DOCUMENTS

| | | | |
|---|---|---|---|
| CH | 661202 A | * | 7/1987 |
| CN | 202218372 U | | 5/2012 |
| CN | 203708433 U | | 7/2014 |
| JP | S48104322 U | | 12/1973 |
| JP | S54151234 U | | 10/1979 |
| WO | 19970048296 A1 | | 12/1997 |

OTHER PUBLICATIONS

Office Action with Search Report dated May 7, 2019 by the China National Intellectual Property Administration for Chinese Patent Application No. 201780015712.2.

English Translation of Office Action dated May 7, 2019 by the China National Intellectual Property Administration for Chinese Patent Application No. 201780015712.2.

* cited by examiner

*Primary Examiner* — Matthew A Eason

(74) *Attorney, Agent, or Firm* — Brian M. Dingman; Dingman IP Law, Pc

(57) ABSTRACT

A headphone with a headband and at least one earcup. The at least one earcup is movably coupled to the headband by a joint that is structured to allow rotation of the earcup relative to the headband about two mutually perpendicular axes, and translation along one of these axes.

18 Claims, 17 Drawing Sheets

HEADPHONE JOINT

CROSS-REFERENCE TO RELATED APPLICATIONS

This application is a continuation of and claims priority to application Ser. No. 15/874,108, filed on Jan. 18, 2018, which is a continuation of and claims priority to U.S. Pat. No. 9,900,682, issued on Feb. 20, 2018.

BACKGROUND

This disclosure relates to a headphone.

Headphones have one or two earcups. In order to be adjustable so as to comfortably fit most heads, the earcups should be able to rotate about the vertical axis and at least one axis that is orthogonal to the vertical axis. The earcups should also be able to translate along the vertical axis. Many headphones use yokes to couple the earcups to the headband to help accomplish the necessary rotations, but yokes are relatively large and are not integral to the headband design. There is a need for an earcup-to-headband joint that provides for rotation about two axes and translation along one axis, while being better integrated into the headband design.

SUMMARY

A headphone joint that is structured to allow rotation of each earcup relative to the headband about two mutually perpendicular axes, and translation along one of these axes. The joint can be integral to the part of the headband and the part of the earcup that interface. There is thus no outward evidence of the joint, unlike the case with headphones that use yokes to rotatably connect the headband to the earcups.

All examples and features mentioned below can be combined in any technically possible way.

In one aspect, a headphone includes a headband and at least one earcup. The at least one earcup is movably coupled to the headband by a joint that is structured to allow rotation of the earcup relative to the headband about two mutually perpendicular axes, and translation along one of these axes.

Embodiments may include one of the following features, or any combination thereof. The joint may comprise a projection on one of the headband and earcup and a slot in the other of the headband and earcup, where the projection is at least in part received by the slot. In one non-limiting example, the projection is on the earcup. The projection may comprise a generally partially spherical surface. The projection may further comprise a generally conical surface with an apex. The apex may be rounded. In one case the apex is generally spherical. The centers of the rounded apex and the generally partially spherical surface of the projection may be essentially coincident. The projection may comprise a stem with a distal end, where the generally conical surface is located at the distal end, and there is a generally partially spherical surface that is adjacent to the generally conical surface. The one of the headband and earcup that includes the projection may further comprise first and second surfaces, each of which slopes away from the projection.

Embodiments may include one of the following features, or any combination thereof. The slot may in part be defined by a first surface that is in contact with the apex. The slot may in part be further defined by second and third surfaces that are adjacent to or in contact with the generally partially spherical surface of the projection. These second and third surfaces may be generally flat, and they may be generally tangent to the generally partially spherical surface of the projection. The slot may have an opening, and an enlarged area adjacent to the opening. The enlarged area may in part be defined by sidewalls that generally follow arcs of a circle, where the center of the circle is generally coincident with the center of the generally partially spherical surface. The slot opening may be narrower than the diameter of the generally partially spherical surface of the projection. The joint may be structured such that rotation about one axis is constrained by the projection. Rotation about the other axis may be constrained by the sloped first and second surfaces of the one of the headband and earcup that includes the projection.

Embodiments may include one of the following features, or any combination thereof. The headphone may further comprise a detent structure that defines a plurality of relative translational positions of the earcup and the headband. The detent structure may comprise at least one spring on one of the headband and earcup, and a series of spring-receiving notches on the other of the headband and earcup.

In another aspect, a headphone includes a headband and at least one earcup. The at least one earcup is movably coupled to the headband by a joint that is structured to allow rotation of the earcup relative to the headband about two mutually perpendicular axes, and translation along one of these axes. The joint comprises a projection on the earcup and a slot in the headband, wherein the projection is at least in part received by the slot and comprises a stem with a distal end, a generally conical surface with an apex located at the distal end, and a generally partially spherical surface adjacent to the generally conical surface. The earcup further comprises first and second surfaces, each of which slopes away from the projection. The slot has an opening, and an enlarged area adjacent to the opening. The slot opening is narrower than the diameter of the generally partially spherical surface of the projection. The slot is in part defined by a first surface that is in contact with the apex and second and third surfaces that are adjacent to or in contact with the generally partially spherical surface of the projection.

Embodiments may include one of the following features, or any combination thereof. The generally conical surface may have a rounded apex. The centers of the rounded apex and the generally partially spherical surface of the projection may be essentially coincident. The second and third surfaces that in part define the slot may be generally flat and generally tangent to the generally partially spherical surface of the projection.

In another aspect, a headphone includes a headband and at least one earcup. The at least one earcup is movably coupled to the headband by a joint that is structured to allow rotation of the earcup relative to the headband about two mutually perpendicular axes, and translation along one of these axes. The joint comprises a projection on the earcup and a slot in the headband. The projection is at least in part received by the slot and comprises a stem with a distal end, a generally conical surface with a generally spherical apex located at the distal end, and a generally partially spherical surface adjacent to the generally conical surface, wherein the centers of the generally spherical apex and the generally partially spherical surface of the projection are essentially coincident. The slot has an opening that is narrower than the diameter of the generally partially spherical surface of the projection, and an enlarged area adjacent to the opening. The enlarged area is in part defined by sidewalls that generally follow arcs of a circle, where the center of the circle is generally coincident with the center of the generally partially spherical surface of the projection.

Embodiments may include one of the following features, or any combination thereof. The earcup may comprise first and second surfaces, each of which slopes away from the projection. The joint may be structured such that rotation about one axis is constrained by the projection, and rotation about the other axis is constrained by the first and second surfaces of the earcup. The slot may in part be defined by a first flat surface that is in contact with the apex.

DETAILED DESCRIPTION

A headphone refers to a device that fits around, on, or in an ear and that radiates acoustic energy into the ear canal. Headphones are sometimes referred to as earphones, earpieces, headsets, earbuds or sport headphones, and can be wired or wireless. A headphone includes an acoustic driver to transduce audio signals to acoustic energy. The acoustic driver may be housed in an earcup. While some of the figures and descriptions following show a single headphone, a headphone may be a single stand-alone unit or one of a pair of headphones (each including a respective acoustic driver and earcup), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality such as a microphone so that they can function as a headset.

In an around or on the ear headphone, the headphone may include a headband and at least one earcup that is arranged to sit on or over an ear of the user. In order to accommodate heads of different sizes and shapes, the earcups need to be able to pivot about the vertical and horizontal axes, and they need to translate for some distance along the vertical axis. The headband can be collapsible or foldable, and can be made of multiple parts. Some headbands include sliders, which may be positioned internal to the headband, that provide for the necessary translation of the earcups. Some headphones include a yoke pivotally mounted to the headband, with the earcups pivotally mounted to the yoke, to provide for the necessary rotation of the earcups.

The headphones of the present disclosure have a joint that couples the earcup to the headband and is structured to allow constrained rotation of the earcups relative to the headband about two mutually perpendicular axes, as well as constrained translation along one of these axes. Thus, the joint described herein enables the necessary rotation and translation to accommodate heads of different sizes and shapes.

Figure 1:
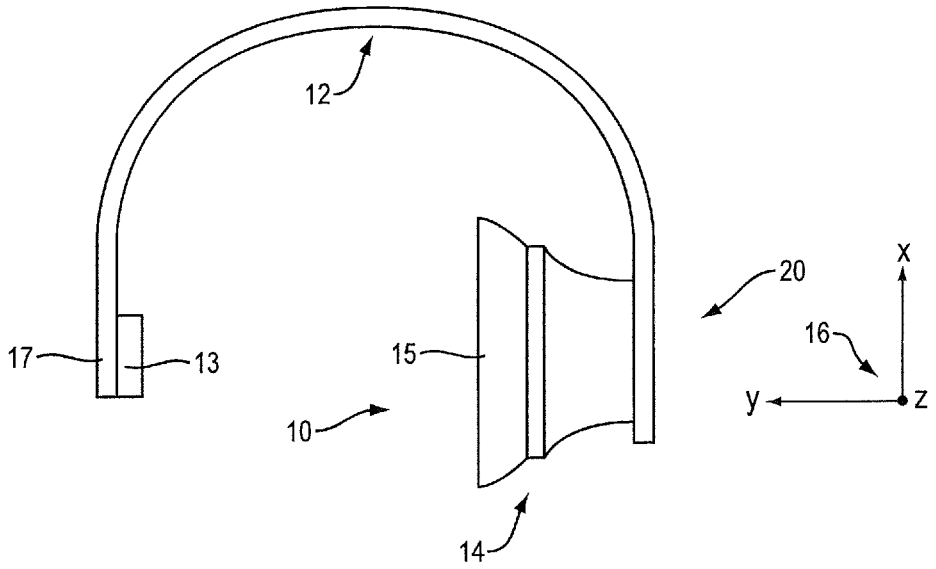
FIG. 1 is a front view of a headphone.

Headphone 10, FIG. 1, includes headband 12 with head cushion 13, and earcup 14 with ear cushion 15. The headphone can alternatively include two earcups, each of which is arranged as described herein. Headband 12 is designed to fit on and over a user's head, and can be constructed in different manners as are known in the art. For example, the headband can be collapsible or foldable, and can be made of multiple parts. Some headbands also include sliders, which may be positioned internal to the headband, that allow the earcups to be slid in and out relative to a fixed part of the headband. Joint 20 movably couples earcup 14 to headband 12 so as to provide for constrained rotation of the earcup about vertical axis x and constrained rotation about the orthogonal horizontal axis z (which is directed in and out of the page in FIG. 1). Joint 20 also provides for constrained translation along the vertical axis x.

Figure 2:
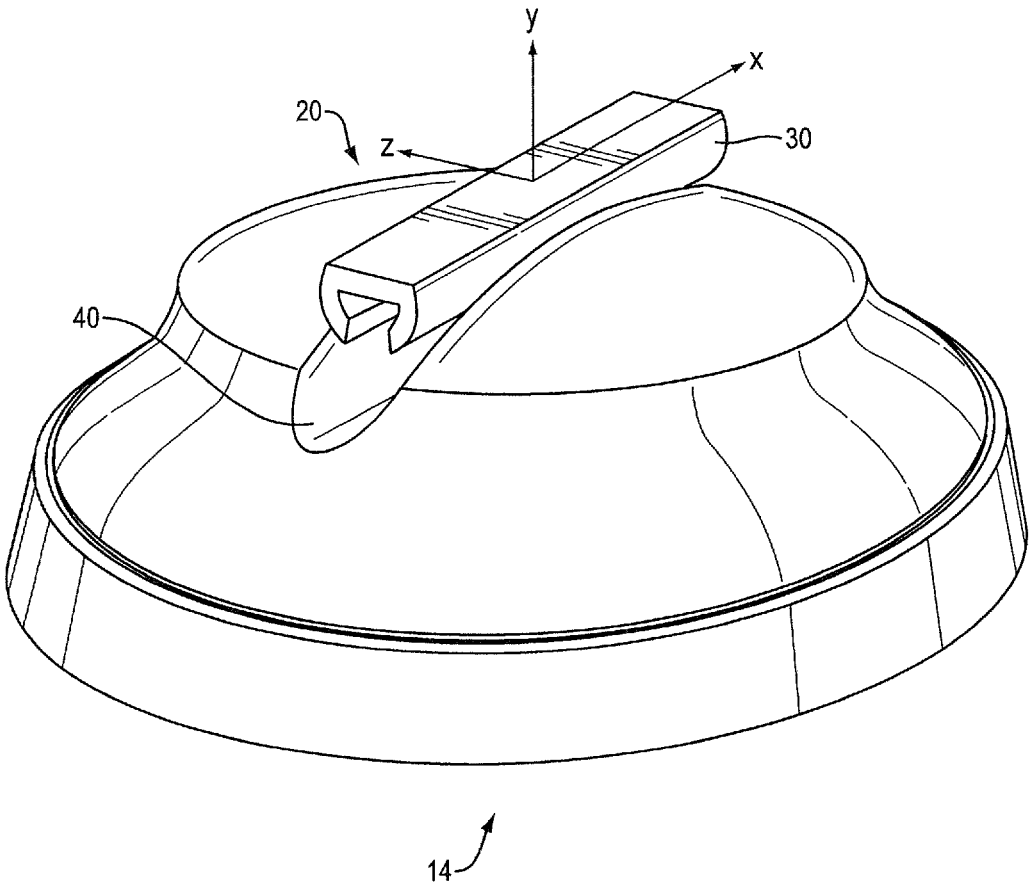
FIG. 2 shows one earcup and a part of the headband that interfaces with the earcup and makes up part of the earcup-to-headband joint herein.

An exemplary earcup 14 is shown in FIG. 2, along with portion 30 of an exemplary headband 12 that is involved in the construction of joint 20. Note that portion 30 may be a separate piece as shown in FIG. 2 but can also be integral to headband 12, or integral to a portion of headband 12. Portion 30 is depicted apart from the headband simply for ease of illustration of the subject joint. As shown in FIG. 2, earcup 14 includes a portion 40 that is also involved in the construction of joint 20. Portion 40 may be, for example, a slot, recess or other feature for receiving portion 30 of the headband 12. The earcup 14 may be a different shape and/or size from the exemplary earcup shown in FIG. 2. The following figures illustrate the joint 20 further.

Figure 3:
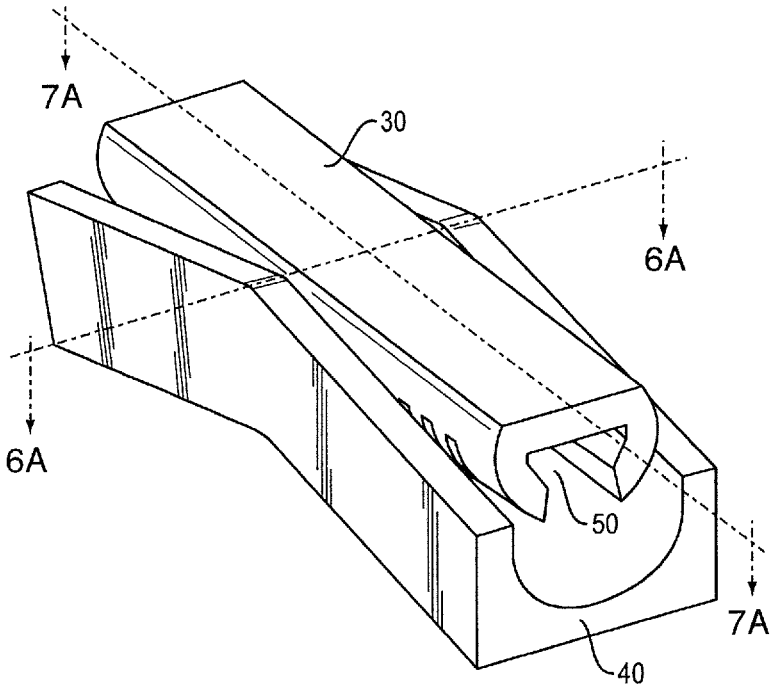
FIG. 3 is a perspective view of portions of the earcup and headband involved in the subject joint.

Portion 40 of earcup 14 that is involved in the construction of joint 20 is shown in FIG. 3, without the rest of the earcup 14. As in FIG. 2, while the components of FIG. 3 are illustrated as being separate pieces or parts, they can also be integral parts of the headband and/or earcup. As in FIG. 2, portion 40 of earcup 14 includes a slot, recess or other feature for receiving portion 30 of the headband 12. Portion 30 of headband 12 also includes a slot 50 that is configured to enable portion 30 to rotate in two mutually two mutually perpendicular axes, and translate along one of these axes, as described herein.

Figure 4:
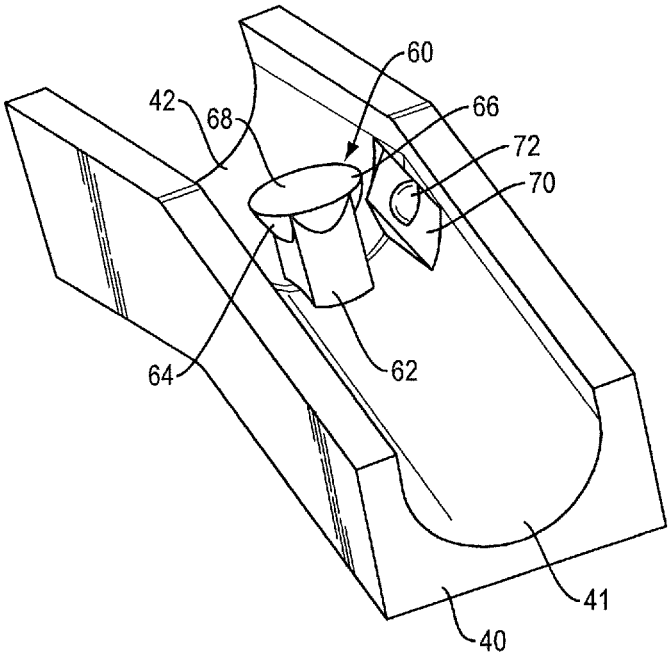
FIG. 4 is a perspective view of the portion of the earcup involved in the subject joint.

Earcup portion 40 is shown alone in FIG. 4. As shown, earcup portion 40 includes a projection 60 that is centered between sloped surfaces 41 and 42 that slope away from projection 60 in both directions along the x axis. Projection 60 may include stem 62 (which can take a variety of shapes and sizes) topped by a generally partially spherical surface 64 that transitions to a generally conical surface 66. The stem 62, generally partially spherical surface 64 and generally conical surface 66 may be formed integrally or may be separate pieces. The generally conical surface 66 includes an apex 68 at the distal end of projection 60. Also shown is detent spring 70 with detent projection 72. All of these aspects of joint 20 are further described below.

Figure 5:
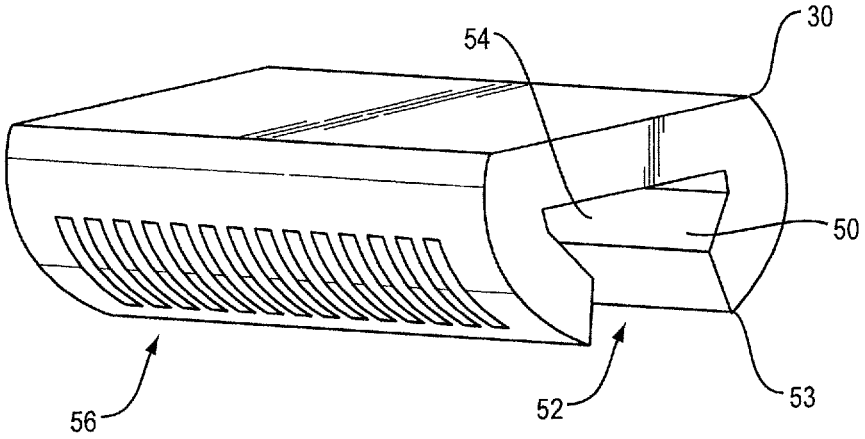
FIG. 5 is a perspective view of the portion of the headband involved in the subject joint.

Headband portion 30 is shown alone in FIG. 5. As shown, slot 50 has an opening 52 that is adjacent to enlarged area 54. As will be described herein, slot 50, opening 52 and enlarged area 54 cooperate with projection 60 of the earcup portion 40 (FIG. 4). Headband portion 30 also includes a lower side 53 that is further described below. A series of detent notches 56 cooperate with detent spring 70 and detent projection 72 of earcup portion 40 (FIG. 4). As with FIG. 4, the aspects of joint 20 shown in FIG. 5 are further described below.

Figure 6A:
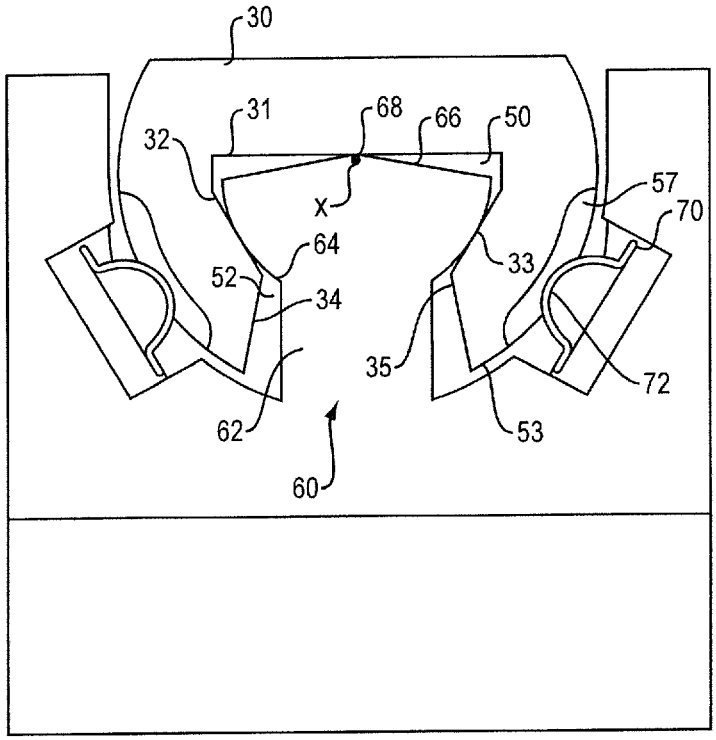
FIG. 6A is a cross-sectional view taken along line 6A-6A of FIG. 3, illustrating the subject joint in the neutral position.

FIG. 6A is a cross-sectional view of the earcup-to-headband joint taken along line 6A-6A of FIG. 3, illustrating joint 20 in the neutral position. Projection 60 is received in slot 50, which is partially defined by first generally flat surface 31 and second and third generally flat surfaces 32 and 33. Projection 60 has a generally partially spherical surface 64 that has a diameter that is larger than slot opening 52 so that projection 60 remains in slot 50. Surface 64 defines a generally spherical contour, at least on its opposed sides that contact or are very close to flat sides 32 and 33 that define part of slot 50. The rest of surface 64 does not need to be spherical or generally spherical. Sides 32 and 33 may be generally tangent to surface 64, although sides 32 and 33 do not necessarily actually contact surface 64. Sides 32 and 33 (which need not be flat but could be curved) may also be looked at as generally following arcs of a circle on which surface 64 lies, where the center of the circle is generally coincident with the center of the generally partially spherical surface 64. Projection 60 further comprises generally conical top (end) surface 66 that has apex 68. Apex 68 may or may not be rounded. Stem 62 of projection 60 is received by slot opening 52.

In the neutral position shown in FIG. 6A, surface 31 contacts apex 68 but does not contact generally conical top surface 66. While surface 66 does not need to be conical, it should define surfaces on either side of the x axis (shown in FIG. 6A as being in and out of the page) that serve as support positions for the headband as relative rotation of the earcup and headband occur. Surface 66 thus acts to support portion 30 (and thus the headband) to inhibit it from rocking on apex 68 upon relative rotation of the earcup and/or the headband about the x axis. Also shown is detent spring 70 with projection 72 that cooperates with detent notch 57 (a second detent spring/projection and notch may also be included on the other side of portion 30). Portion 30 can be slid along the x axis in both directions. The series of detent notches 56 (which are preferably but not necessarily on both sides of portion 30) define a series of spaced stop positions for the relative translational motions of portions 30 and 40. In operation, when portion 30 is slid along the x axis, it will move freely until it engages a stop position defined by detent notches 56, thus enabling a user to customize the length of the headband 12 to accommodate a variety of head shapes and sizes. While a detent mechanism is shown in FIG. 6A to provide the spaced stop positions, other mechanisms could be used, including friction or a different type of mechanical feature on each portion 30 and 40 that engage with each other.

Figure 6B:
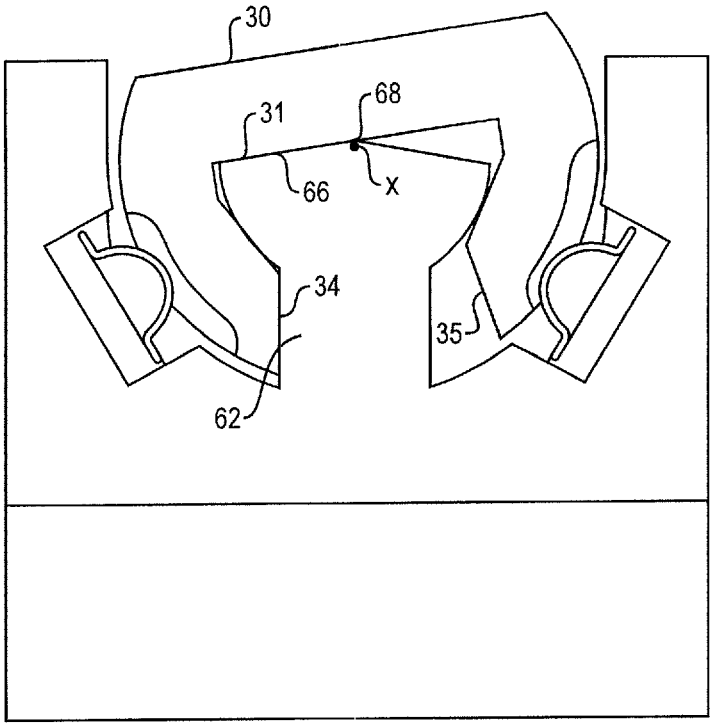
FIG. 6B is a view similar to that of FIG. 6A but illustrates rotation about the x axis.

FIG. 6B is a view similar to that of FIG. 6A but illustrates full rotation in one direction about the x axis, where surface 31 contacts surface 66. As shown in FIG. 6B, end surfaces 34 and 35 of portion 30 are preferably constructed and arranged such that their contact with stem 62 is actually what defines the rotation end or stop positions. Accordingly, when end surface 34 contacts stem 62, further rotation about the x axis in that direction is prohibited. The angle of conical surface 66 from a horizontal line is selected such that the desired full angle of rotation is supported. In non-limiting examples, this angle is between about 10 degrees and about 25 degrees so as to accommodate heads of different size and shape. End surfaces 34 and 35 along with stem 62 thus enable constrained rotation of the earcup 14 about the x axis. In other examples, surface 66 could be constructed and arranged to define the rotation end or stop positions. Rotation in the other direction would be handled in the same way. The angle of surface 66 (in both directions) and the locations of ends 34 and 35 (via, e.g., the diameter of stem 62) are selected to achieve a desired angular rotation about the x axis; in the present non-limiting example this rotation is about 10 degrees in either direction about the x axis.

Figure 6C:
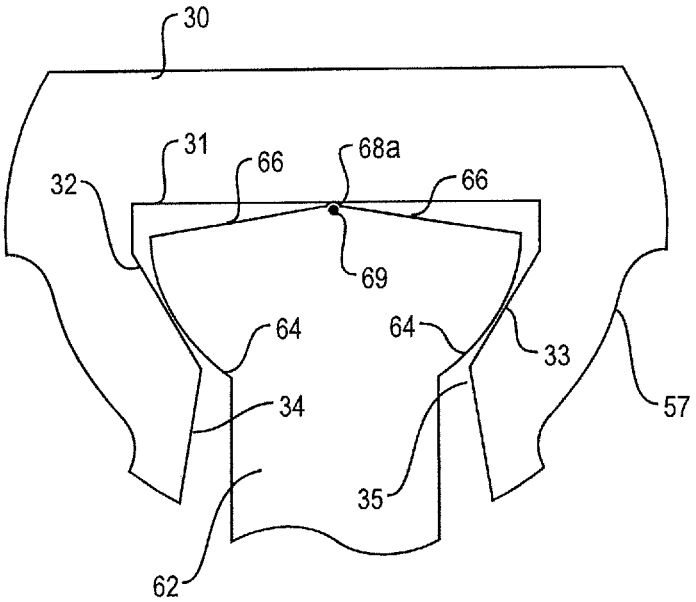
FIG. 6C is a view similar to that of FIG. 6A but illustrates a slightly different example of the joint.

FIG. 6C is a view similar to that of FIG. 6A but illustrates a slightly different example of the joint, where apex 68*a* is rounded, e.g., generally partially spherical. The centers of the rounded apex 68*a* and the generally partially spherical surface 64 may be essentially coincident at center 69. This both ensures and constrains the purely rotational motion about center 69. Rounded apex 68*a* provides more support for surface 31 as rotation about the x axis occurs when compared to examples where apex is not rounded. Also seen in more detail in FIG. 6C are generally tangent surfaces 32 and 33, which are located close to or touching surface 64. Surfaces 32 and 33 remain generally tangent to surface 64 as rotation about the x axis occurs. Surfaces 32 and 33 thus inhibit side-to-side sliding motion of surface 31 on apex 68*a*, and so further constrain relative motions of the earcup and headband to rotations about the x and z axes, and translation along the x axis. Translation along the z axis is also inhibited because portion 30 sits in the slot in portion 40.

Figure 7A:
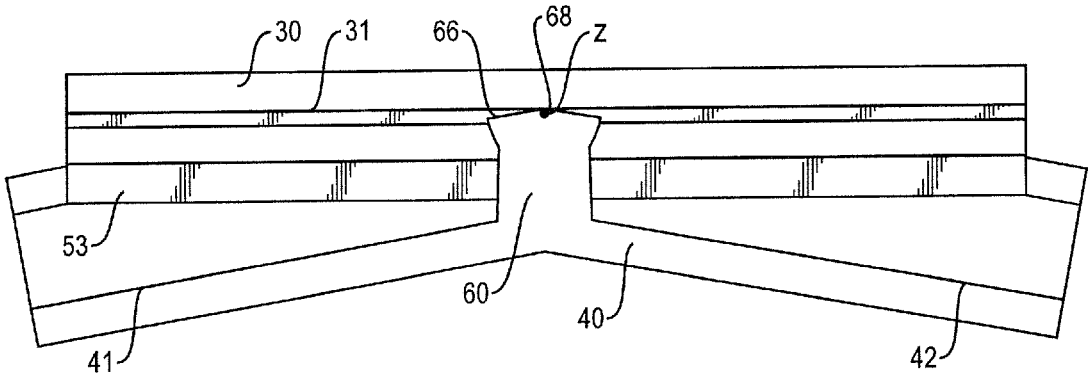
FIG. 7A is a cross-sectional view taken along line 7A-7A of FIG. 3, illustrating the subject joint in the neutral position.
Figure 7B:
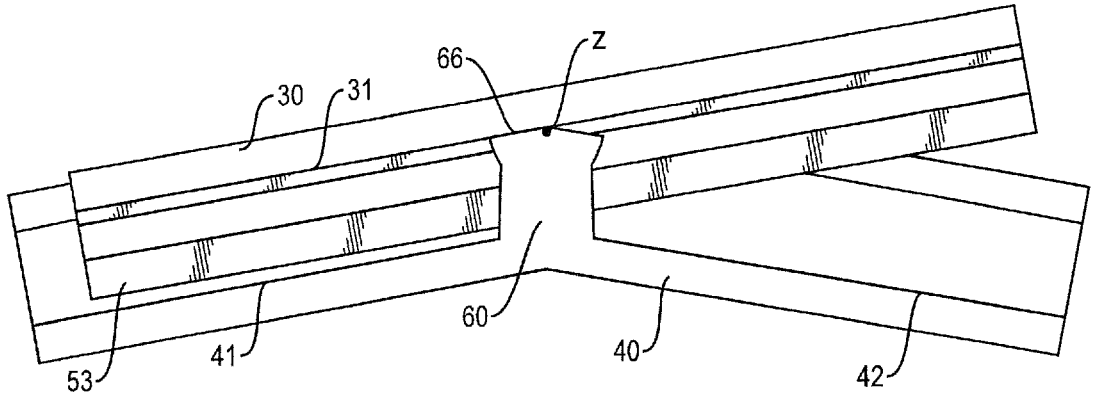
FIG. 7B is a view similar to that of FIG. 7A but illustrates rotation about the z axis.
Figure 8:
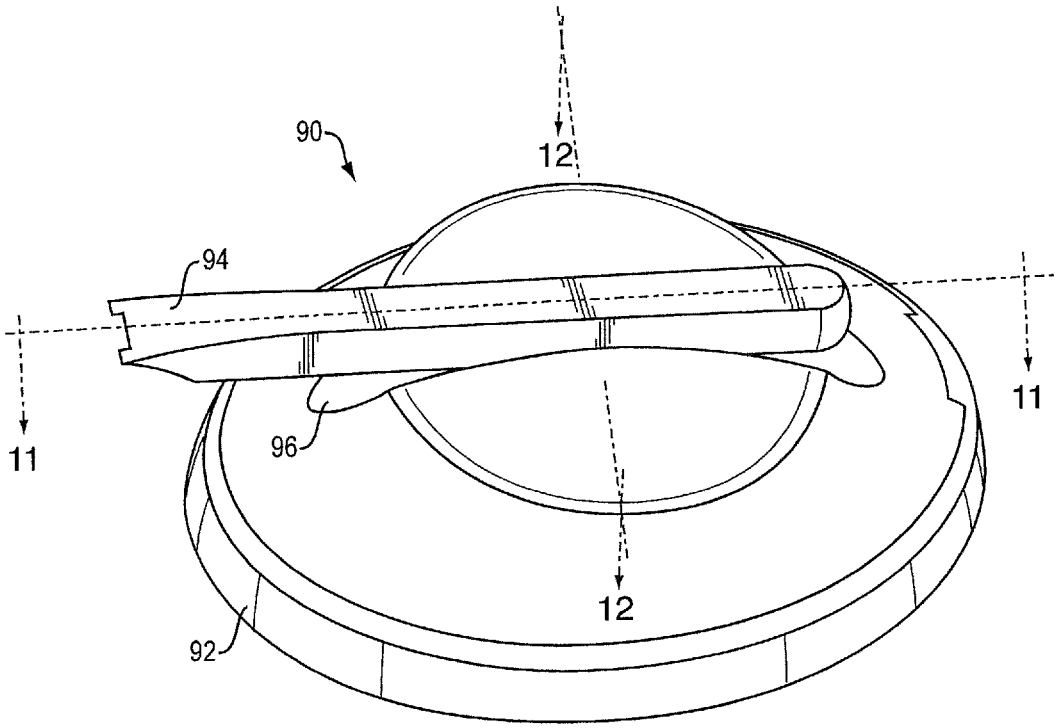
FIG. 8 is a partial perspective view of another headphone joint.
Figure 9:
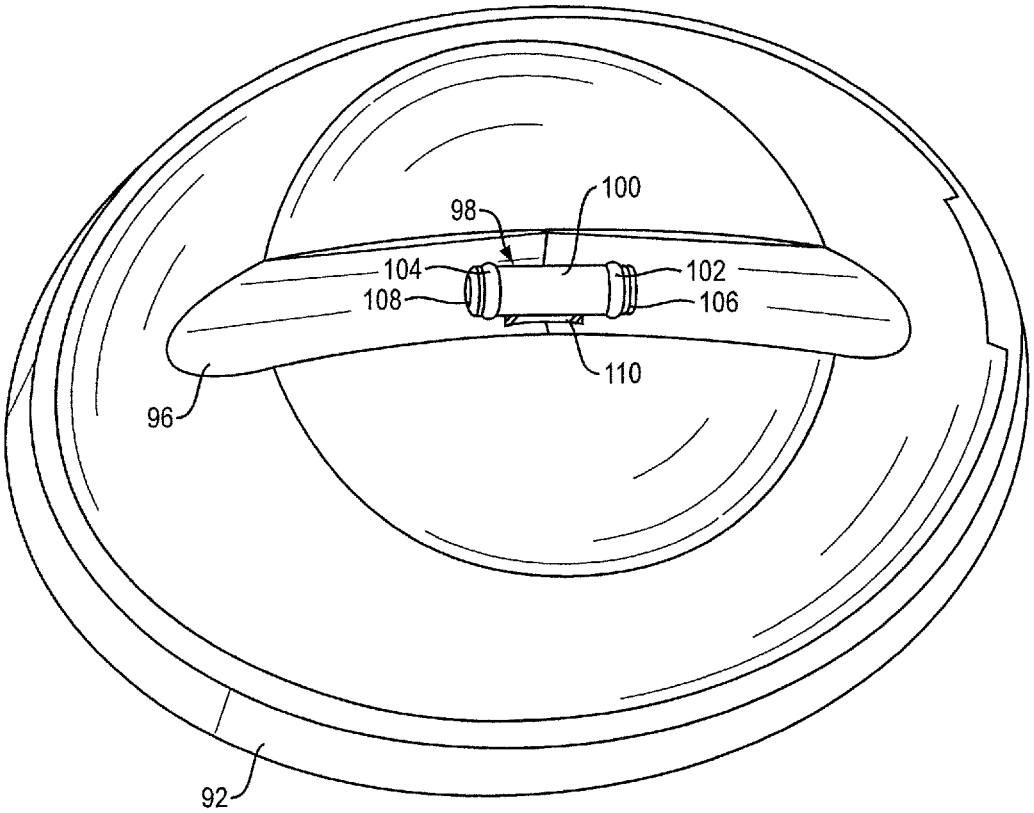
FIG. 9 is a perspective view of the earcup of the joint of FIG. 8.

Rotations about the z axis are depicted in FIGS. 7A and 7B (where the z axis is into and out of the page of the drawing). The neutral position is shown in FIG. 7A, where surface 31 of headband portion 30 sits on apex 68. Portions 30 and 40 are free to relatively rotate about the z axis until lower side 53 of portion 30 contacts one of sloped surfaces 41 and 42 (contact is not shown in FIG. 7B simply for the sake of clarity). Contact of these two surfaces preferably defines the rotation end ranges, which in this non-limiting example are about 10 degrees in either direction about the z axis, but could be more or less than 10 degrees. The angle at which the sloped surfaces 41 and 42 slope is thus selected to achieve a desired angular rotation about the z axis. In other examples, surface 66 could be constructed and arranged to define the rotation end or stop positions about the z axis.

One of many possible alternative joints is depicted in FIGS. 8-12. Joint 90 movably couples earcup 92 to headband slider 94 so as to provide for constrained rotation of the earcup about the vertical axis (which is parallel to line 11-11, FIG. 8), and constrained rotation about the orthogonal horizontal axis (which is parallel to line 12-12). Joint 90 also provides for constrained translation along the vertical axis via slider 94, which can translate relative to earcup 92 within earcup slot 96 along the vertical axis.

Earcup projection 98 of joint 90 is shown in FIGS. 9-12. Projection 98 includes stem 110 that is pivotally coupled to earcup 92 via pin 128 that passes through hole 154, so as to allow relative rotation about the z axis (see FIG. 11A). Generally cylindrical member 100 is carried at the distal end of stem 110. Member 100 has tapered, rounded ends 108 and 106, but the ends need not be rounded. Member 100 carries o-rings 102 and 104, which may have but need not have rectangular cross-sectional shapes to inhibit them from rolling in their grooves. Rounding ends 108 and 106 eases assembly of the o-rings and avoids sharp corners that might catch on the tube wall. Stem 110 and member 100 may be but need not be integrally molded along with earcup 92.

Figure 10:
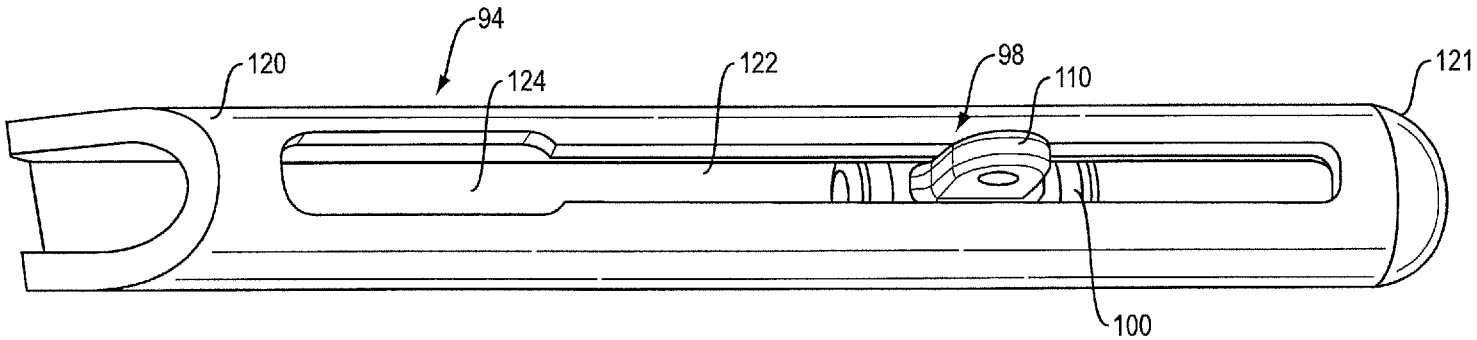
FIG. 10 is a perspective view of the slider of the joint of FIG. 8.
Figure 11A:
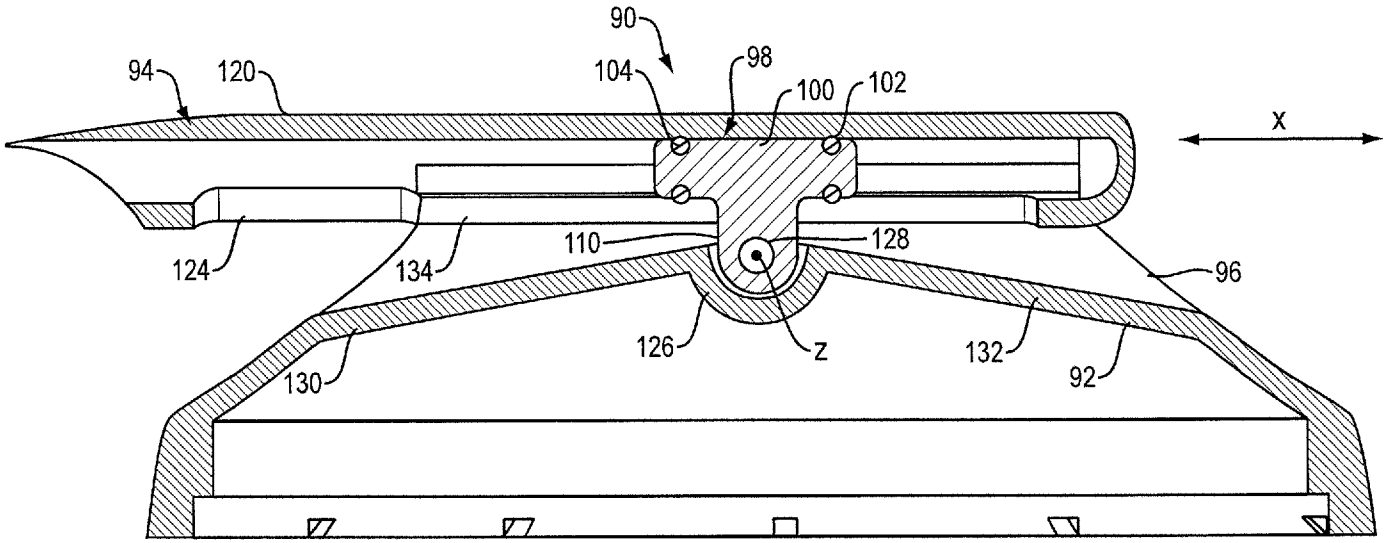
FIG. 11A is a cross-sectional view taken along line 11-11 of FIG. 8, showing the joint in the neutral position.
Figure 11B:
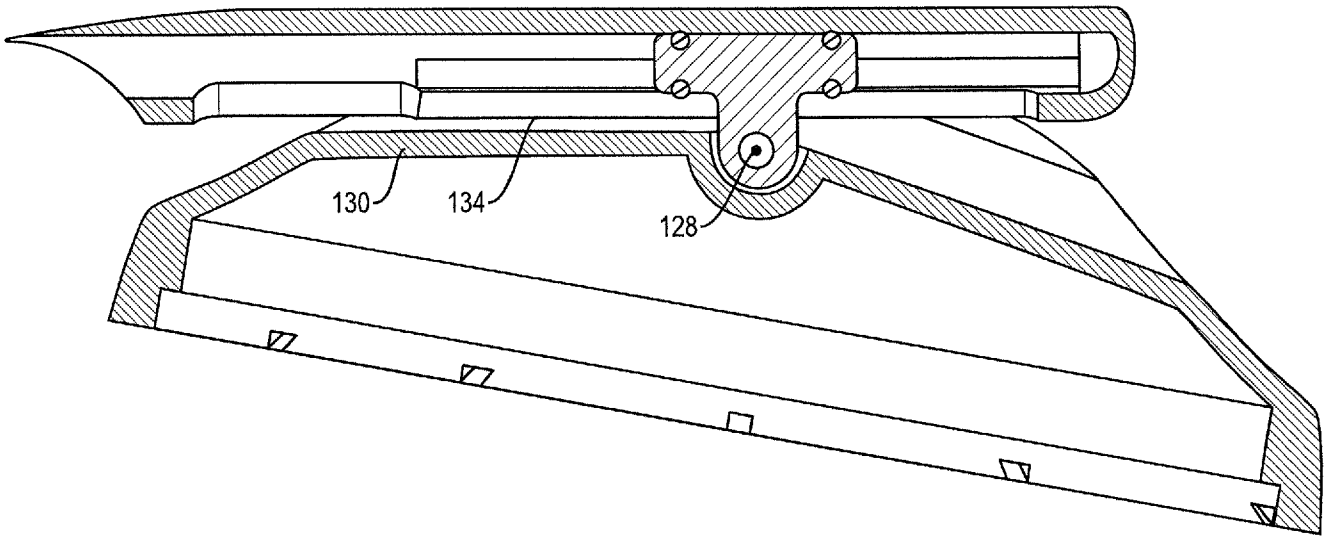
FIG. 11B is a view similar to that of FIG. 11A, but showing the joint in a rotated position.
Figure 12A:
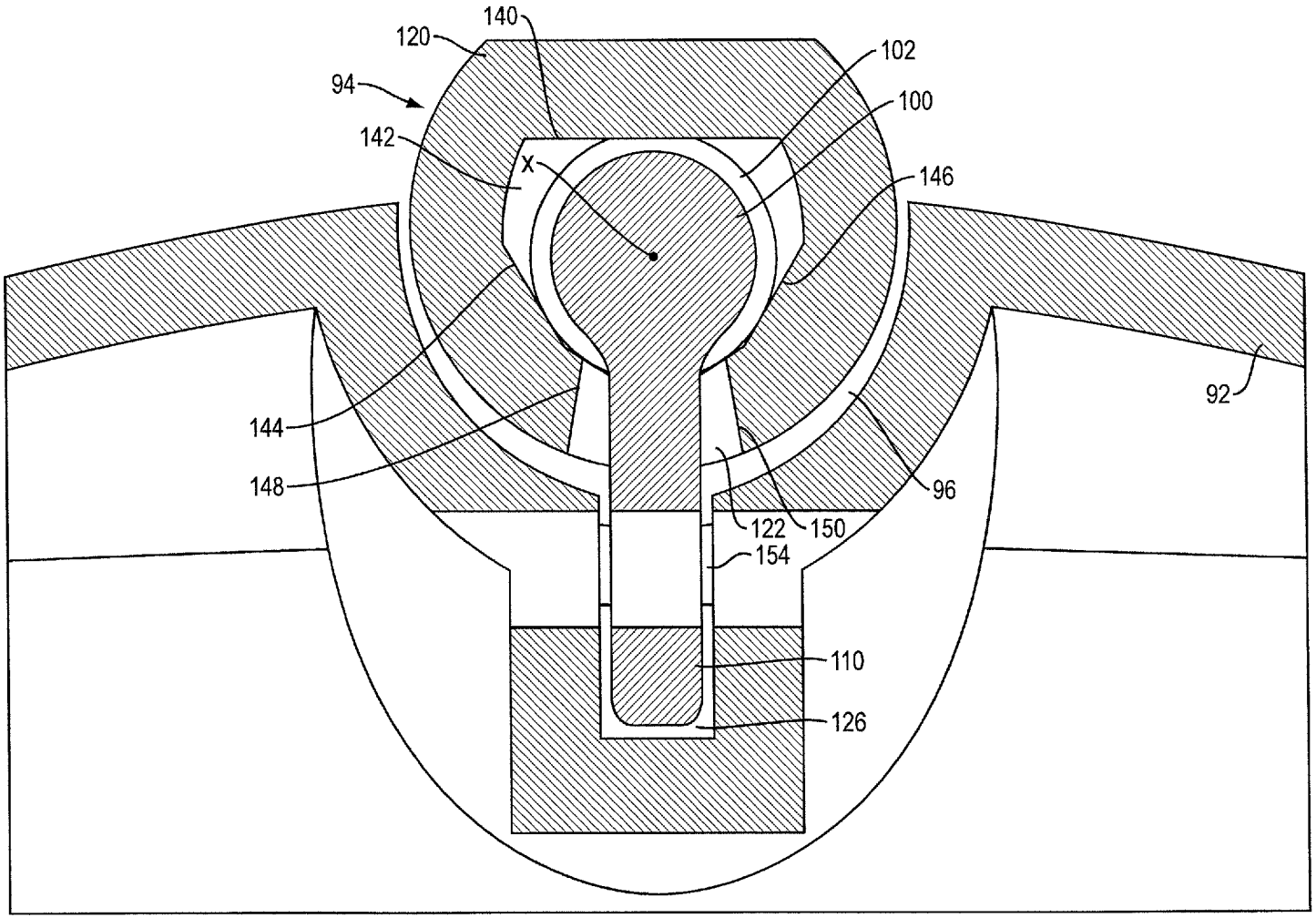
FIG. 12A is a cross-sectional view taken along line 12-12 of FIG. 8, showing the joint in the neutral position.
Figure 12B:
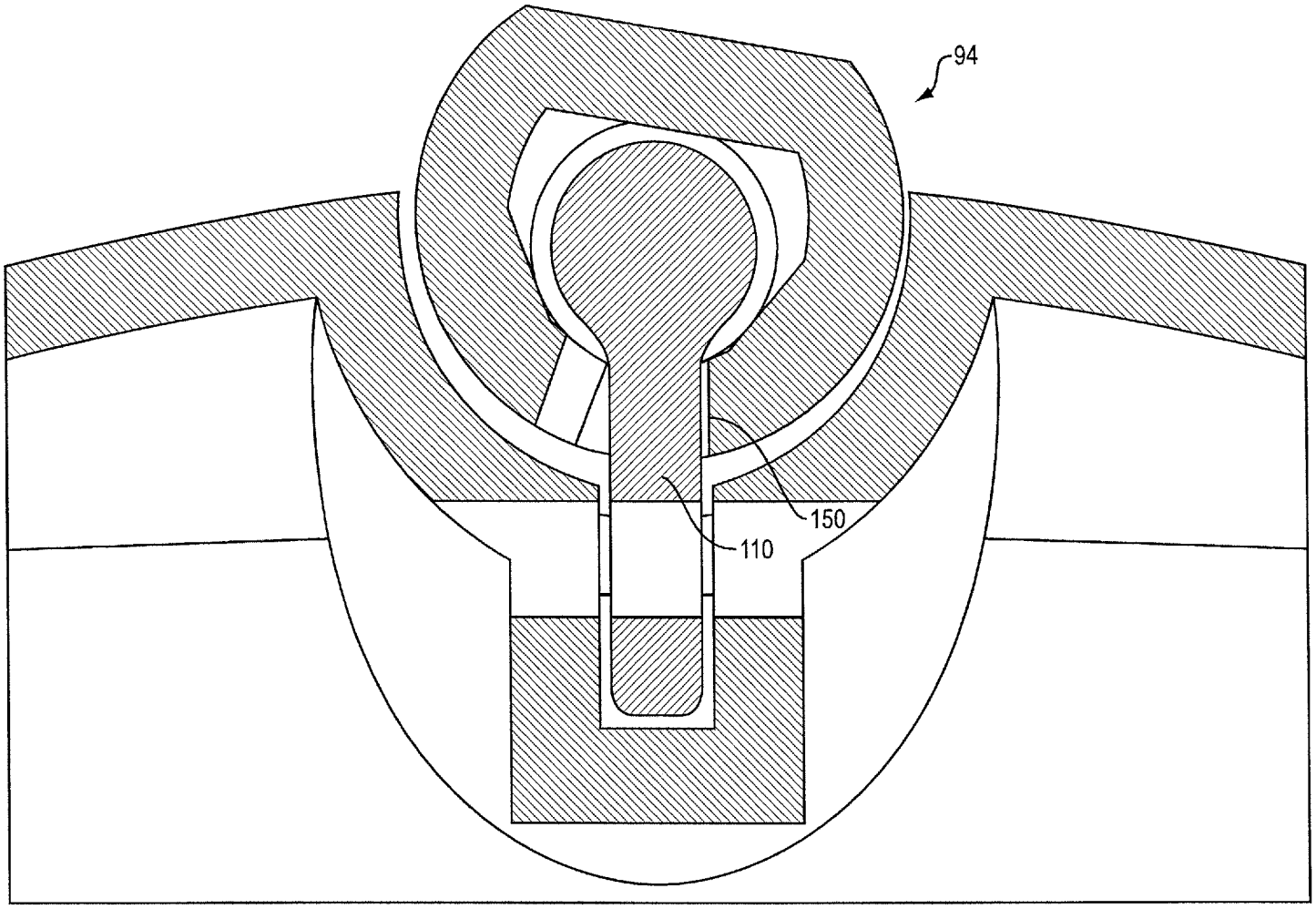
FIG. 12B is a view similar to that of FIG. 12A, but showing the joint in a rotated position.

Headband slider 94 of joint 90 is shown in FIGS. 10-12. Slider 94 is part of the headphone headband, which is not further shown in FIGS. 8-12, simply for ease of illustration. Slider 94 may be but need not be integrally molded with the headphone headband. Slider 94 comprises tube 120 with closed end 121 and elongated longitudinal slot 122 through which stem 110 projects. Tube 120 thus is supported by and rides on projection 98. Slot 122 includes enlarged portion 124 that allows member 100 to be fitted into tube 120 in order to facilitate assembly of the headphones. Portion 124 could be closed or narrowed after assembly in order to prevent decoupling. Other constructions could prevent decoupling of member 100 and tube 120. Several non-limiting constructions include a stop member that plugs aperture 124; this could be a separate plug or an end of a headband spring that slides into the tube and is locked in place. Another option would be to extend slot 122 through one end of tube 120 to allow for insertion of member 100 into tube 120, and then closing the open end of the tube, for example with end 121. Another option would be to make stem 110 and member 100 separate pieces that were coupled together in place so that member 100 could be inserted from one end of the tube. Stem 110 is slightly narrower than the width of slot 122 so that tube 120 and stem 110 (and thus earcup 92) can relatively rotate about the z axis, up to an angular extent at which stem 110 contacts one of the sidewalls the define slot 122. This rotation is further shown and described below relative to FIGS. 12A and 12B.

Joint 90 is depicted in its neutral position in FIGS. 11A and 12A, wherein slider 94 is approximately centered in its travel along the x axis, and is rotationally centered about the x and z axes. Stem 110 of projection 98 fits into slot 126 in earcup 92. O-rings 102 and 104 accomplish a frictional engagement between generally cylindrical member 100 and the interior of tube 120. The friction should be sufficient to hold the earcup in place but allow it to be translated up and down by the user. Frictional engagement could be accomplished in other manners, without o-rings. For example, member 100 could have a diameter slightly greater than the interior diameter of tube 120 so that the two are held in place. Tube 120 could have enough flexibility to allow the holding force to be overcome by the user. Rotation about the z axis is constrained (stopped) when lower wall 134 of tube 120 contacts either sloped wall 130 or sloped wall 132 of earcup 92. In one non-limiting example, the rotations that can be accommodated are about +/−10 degrees from the neutral position. See FIG. 11B which illustrates one stop position wherein wall 134 has contacted wall 130.

Constrained rotation about the x axis is depicted in FIGS. 12A and 12B. Tube 120 defines an interior cavity 142 in which member 100 is located. Cavity 142 may be defined by top wall 140 and angled sidewalls 144 and 146. Top wall 140 need not be flat. O-ring 102 is large enough to create an interference fit with cavity 142; in this non-limiting illustrative example this is accomplished with the three flat walls 140, 144 and 146 that thereby accomplish a three-point interference fit with member 100. The three points can be but need not be at about 120 degree intervals around the circumference of member 100. A three-point fit is not required but does help to balance the forces needed to rotate about and translate along the x axis. The rotational end points are established when either of end walls 148 and 150 contacts stem 110. One such end point is illustrated in FIG. 12B, wherein end wall 150 has contacted stem 110. Note that the tube shape shown is not necessary to the interference fit, as many other shapes are possible.

Figure 13:
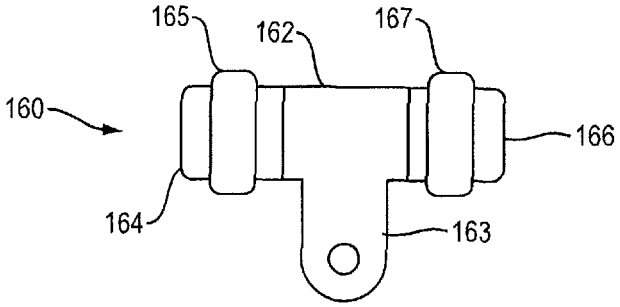
FIG. 13 illustrates an alternative projection to that shown in FIGS. 9 and 10.

One of many possible alternative earcup projection designs is depicted in FIG. 13. Projection 160 includes stem 163 that is an integral part of center section 162. End sections 164 and 166, which carry o-rings 165 and 167, respectively, are adapted to rotate about the x axis relative to section 162 (e.g., by using bearing surfaces where section 162 meets sections 164 and 166). This construction allows rotation about the z axis to occur without the o-rings moving relative to the headband, which provides for easier pivoting about the z axis as compared to that of projection 98.

Figure 14A:
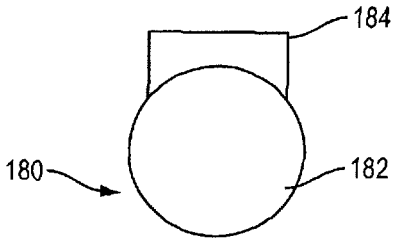
FIGS. 14A and 14B are side and top views, respectively, of another projection.
Figure 14B:
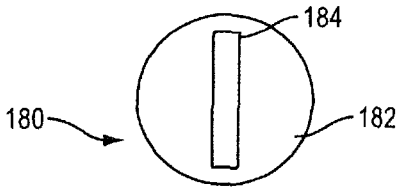
Figure 15A:
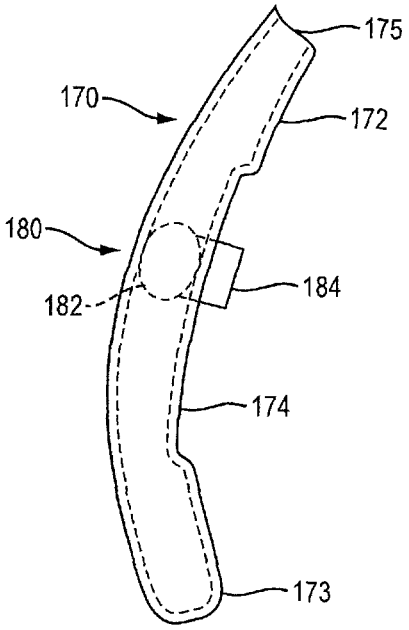
FIGS. 15A and 15B are side and top views, respectively, of a slider that can be used with the projection of FIGS. 14A and 14B.
Figure 15B:
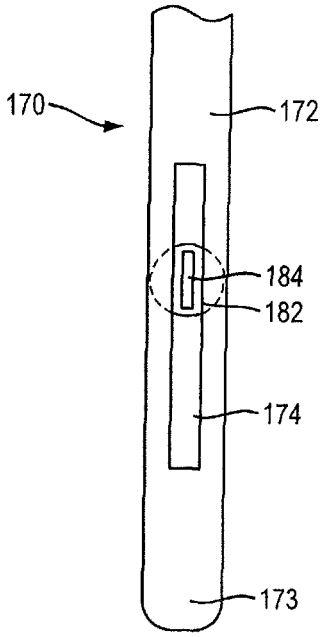

Two additional alternatives for the subject joint are depicted in FIGS. 14 and 15. Projection 180 includes a generally spherical body 182 carried on the end of stem 184, which would be coupled to or integral with the earcup (not shown). Generally spherical body 182 is part of a ball joint 170 once body 182 is captured in tube 172, FIG. 15. As with joint 90, rotation about the x axis is constrained by stem 184 being slightly narrower than the width of slot 174 in tube 172 such that the stem contacts the slot side walls to establish the rotational end points as the earcup and headband pivot about the x axis. The relative widths are selected to achieve a desired rotational range. Rotation about the z axis is provided by the relative rotation of sphere 182 within the cylindrical central longitudinal opening 175 of tube 172. Desired frictional engagement (to hold the joint in place) can be accomplished by making the diameter of opening 175 about 0.95 times the diameter of sphere 182, and providing sufficient flexibility to tube 172 (e.g., by making the tube of spring steel or another flexible material).

FIG. 15A also depicts another alternative that can be applied to the joints disclosed herein, where tube 172 is curved along the x axis rather than straight as in the other examples. A curved tube will sit closer to the head and so may be a preferred industrial design. In order to accommodate rotation of a curved tube about the x axis, slot 96 in earcup 92 (see FIG. 9 for example) would need to be shaped differently. For example, the ends of the slot could be wider than the middle (similar to the shape of butterfly wings) so that the tube does not contact the sides of earcup slot 96 as this rotation occurs.

The joint disclosed herein can be used in other applications where constrained rotations about two orthogonal axes, with constrained translation along one of these axes, is needed. One non-limiting example includes a boom microphone, where the microphone needed to be rotatable in two axes and translatable along one of these axes.

A number of implementations have been described. Nevertheless, it will be understood that additional modifications may be made without departing from the scope of the inventive concepts described herein, and, accordingly, other embodiments are within the scope of the following claims.

What is claimed is:

1. A joint that is configured to couple an earcup of a headphone to a headband of the headphone, comprising:

a slot in one of the headband and the earcup;

a projection on the other of the headband and the earcup, wherein the projection is at least in part located in the slot; and a friction element comprising a compressible element that constrains a rotation of the projection relative to the earcup;

wherein the projection comprises a structure that creates a frictional engagement of the projection in the slot.

2. The joint of claim 1, wherein the structure that creates a frictional engagement of the projection in the slot comprises a compressible element.

3. The joint of claim 2, wherein the compressible element creates an interference fit with the slot.

4. The joint of claim 2, wherein the compressible element is compressed against an inner wall of the slot.

5. The joint of claim 1, wherein the structure that creates a frictional engagement of the projection in the slot is configured to provide forces that resist translation of the earcup relative to the headband along a first axis.

6. The joint of claim 5, wherein the slot at least in part lies along a slot axis that is parallel to the first axis.

7. The joint of claim 1, wherein the projection comprises a generally cylindrical member.

8. The joint of claim 7, wherein the slot is generally cylindrical.

9. The joint of claim 1, wherein the projection comprises a stem that is coupled to the earcup such that the stem is configured to pivot relative to the earcup.

10. The joint of claim 9, wherein the stem is coupled to the earcup by a pin.

11. The joint of claim 1, wherein the slot is in a slider that is part of the headband.

12. The joint of claim 11, wherein the slider is curved.

13. The joint of claim 11, wherein the slider sits in a recess in the earcup.

14. The joint of claim 9, wherein the joint is structured such that rotation about one axis is constrained by the stem.

15. The joint of claim 14, wherein the stem passes through the slot, and the slot is wider than the stem and comprises end walls proximate the stem, wherein the stem can rotate relative to the slider, and end points of this rotation are established when the stem contacts either end wall.

16. The joint of claim 1, wherein the projection is on the earcup and the slot is in the headband.

17. The joint of claim 1, wherein the compressible element comprises an o-ring.

18. A joint that is configured to couple an earcup of a headphone to a headband of the headphone, comprising:

a generally cylindrical slot in the headband;

a generally cylindrical member on the earcup and that is at least in part located in the slot, wherein the generally cylindrical member comprises a compressible element that is compressed against an inner wall of the slot and creates a frictional interference fit with the slot that is configured to provide forces that resist translation of the earcup relative to the headband along a first axis; and a stem that carries the generally cylindrical member and is coupled to the earcup such that the stem is configured to pivot relative to the earcup.

* * * * *